US007601022B2

(12) United States Patent
Huang

(10) Patent No.: US 7,601,022 B2
(45) Date of Patent: Oct. 13, 2009

(54) ELECTRICAL CONNECTOR AND ADAPTER STRUCTURE WITH RAISED PORTION

(76) Inventor: George Y. Huang, Total Technologies, Ltd., 9 Studebaker, Irvine, CA (US) 92618

( * ) Notice: Subject to any disclaimer, the term of this patent is extended or adjusted under 35 U.S.C. 154(b) by 350 days.

(21) Appl. No.: 10/642,413

(22) Filed: Aug. 15, 2003

(65) Prior Publication Data

US 2004/0053533 A1 Mar. 18, 2004

Related U.S. Application Data

(63) Continuation of application No. 09/657,869, filed on Sep. 8, 2000, now abandoned.

(51) Int. Cl.
*H01R 13/504* (2006.01)

(52) U.S. Cl. ..... 439/491; 439/606

(58) Field of Classification Search ..... 439/604–606, 439/488, 491, 41–42; D11/90–96
See application file for complete search history.

(56) References Cited

U.S. PATENT DOCUMENTS

D208,147 S * 7/1967 Clayton ..... D8/310
3,573,713 A * 4/1971 Enright et al. ..... 439/402
4,164,725 A * 8/1979 Wiebe ..... 337/198
4,202,351 A * 5/1980 Biche ..... 600/508
4,256,159 A * 3/1981 Williams ..... 152/524
4,263,085 A * 4/1981 Ellis ..... 156/542
4,275,768 A * 6/1981 Riggs et al. ..... 138/104
4,279,852 A * 7/1981 Engelmann ..... 264/227
4,704,091 A * 11/1987 Owens et al. ..... 439/281
4,960,391 A * 10/1990 Beinhaur et al. ..... 439/559
5,449,302 A * 9/1995 Yarbrough et al. ..... 439/680
5,603,796 A * 2/1997 Baker ..... 156/272.8
5,642,667 A * 7/1997 Sastre ..... 101/405
5,735,699 A * 4/1998 Tan et al. ..... 439/92
5,863,210 A * 1/1999 Reisinger ..... 439/41
6,296,526 B1 * 10/2001 Hussaini et al. ..... 439/668
6,886,284 B2 * 5/2005 Lizotte ..... 42/1.01
2003/0119359 A1 * 6/2003 Fung ..... 439/606

* cited by examiner

*Primary Examiner*—Renee Luebke
(74) *Attorney, Agent, or Firm*—Duncan Palmatier

(57) ABSTRACT

The invention discloses a computer connector or adapter housing structure with a raised portion. When plastic is molded around the housing, the raised portion is left exposed. This exposed portion of the housing provides a place to incorporate designs, such as business logos, words or numbers, or a gripping surface.

15 Claims, 4 Drawing Sheets

ELECTRICAL CONNECTOR AND ADAPTER STRUCTURE WITH RAISED PORTION

CROSS REFERENCE TO RELATED APPLICATIONS

This is a CONTINUATION of application Ser. No. 09/657,869, filed Sep. 8, 2000 now abandoned.

This Continuation claims benefit of the filing date of application Ser. No. 09/657,869.

BACKGROUND OF THE INVENTION

1. Field of the Invention

This invention relates to electrical connector and adapter structures. Such connectors are used in the electronics industry in cables and adapters and similar devices that connect components. The invention discloses a connector or adapter housing structure with a raised portion. When plastic is molded around the housing, the raised portion is left exposed. This exposed portion of the housing provides a place to incorporate designs, such as business logos or gripping surfaces.

2. Discussion of the Prior Art

The variety of electronics connectors is large, but they share similarities in their manufacture and assembly. FIG. 1 shows a cross-section of a conventional cable connector 10. The most common cable connectors have a metal housing 14 with a back end 19 through which a cable 13 is inserted. A connector plug 12 with pins or receptacles (not shown), designed to plug into the appropriate part on a component (not shown), is attached to the front end 22 of the connector 10. The cable 13 contains electrical conductors or wires 21 which are connected by soldering or crimping to the inward projections 23 of the pins or receptacles. Over the metal housing 14, plastic is injection molded to form an outer plastic covering 11. The plastic covering 11 often terminates around the cable 13 to form a "strain relief" 16 that prevents the cable from bending too sharply.

To provide a place for a manufacturer's name or for part identification, the plastic covering 11 of conventional connectors is sometimes molded with a recess 20. In the recess 20, identifying logos, designs, words, or numbers are often formed in the molding process, leaving raised or indented surfaces (not shown) in the plastic covering 11. Or, a label (not shown) can be affixed in the recess 20 after molding. Some designs have a raised surface design by placing the cable connector 10 or adapter in a second injection mold and adding a second plastic surface 15. This two-step molding process allows different colors or textures of plastic to be used.

Recent designs use transparent plastic in the molded plastic covering 11, so that the parts and surfaces below, such as the housing 14, can be seen. This design has been popularized by the Macintosh "iMac" computers. The iMac products use transparent plastic outer shells or materials to show the parts and surfaces below. Computer connector and adapter assemblies have been created that mimic this feature. However, the transparent plastic surfaces do not provide a surface on which logos or information can be easily discerned. To solve this problem, some connectors and adapters have identifying logos or information incorporated onto the metal housing 14, so that the logos or information may be seen beneath the transparent plastic covering 11. But the result is imperfect, since the transparent plastic obscures the housing surface and design below.

Similar structures are used for other connector shapes, such as cylindrical connectors, and for adapters.

SUMMARY OF THE INVENTION

The present invention provides a connector or adapter housing structure that provides a raised portion that will be exposed after the outer plastic covering is molded onto the connector or adapter. This raised portion of the housing exposes an area where logos or other information can be placed on or molded into the raised portion. This eliminates the need to apply a logo through a second injection molding process or by affixing it in a later manufacturing step. The raised portion also provides a more discernable and durable surface for logos than the molded plastic covering. Moreover, with transparent plastic coverings of recent designs, the raised portion of the present invention provides the best surface for logos or other information. In this way, a cable connector or adapter can be manufactured and assembled with fewer parts and steps, and the finished product will provide a superior surface for logos and information.

DESCRIPTION OF THE INVENTION

Figure 1:
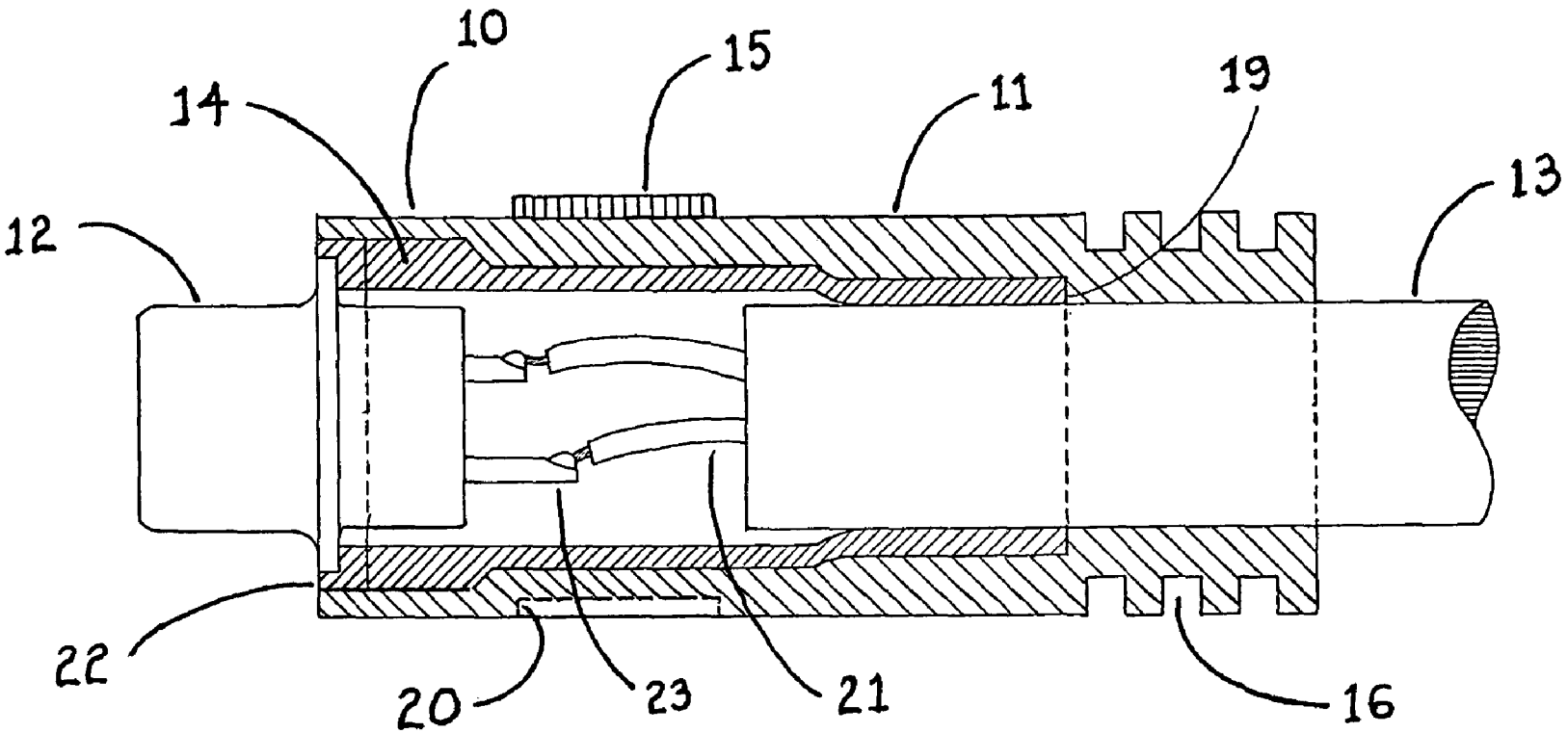
Fig. 1 Prior art
FIG. 1 is a cross-section view of a prior art cable connector.
Figure 3:
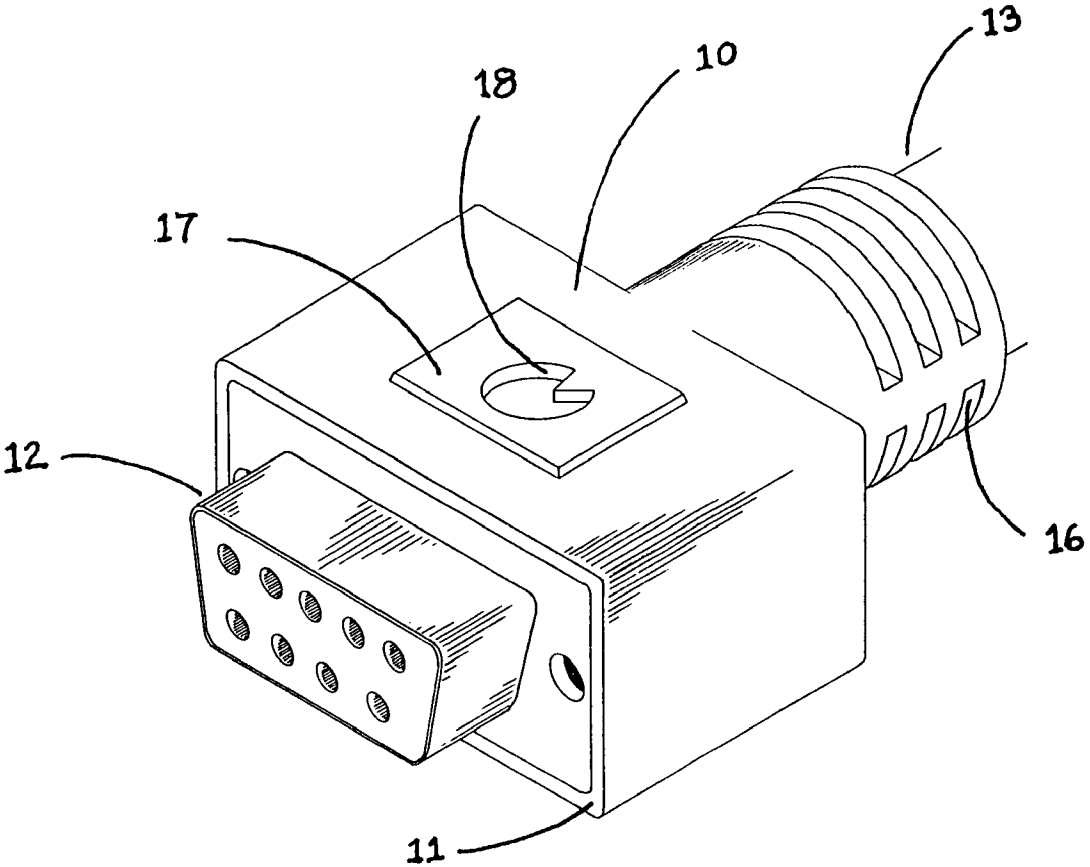
FIG. 3 is a three-quarter view of a cable connector according to the present invention.
Figure 4:
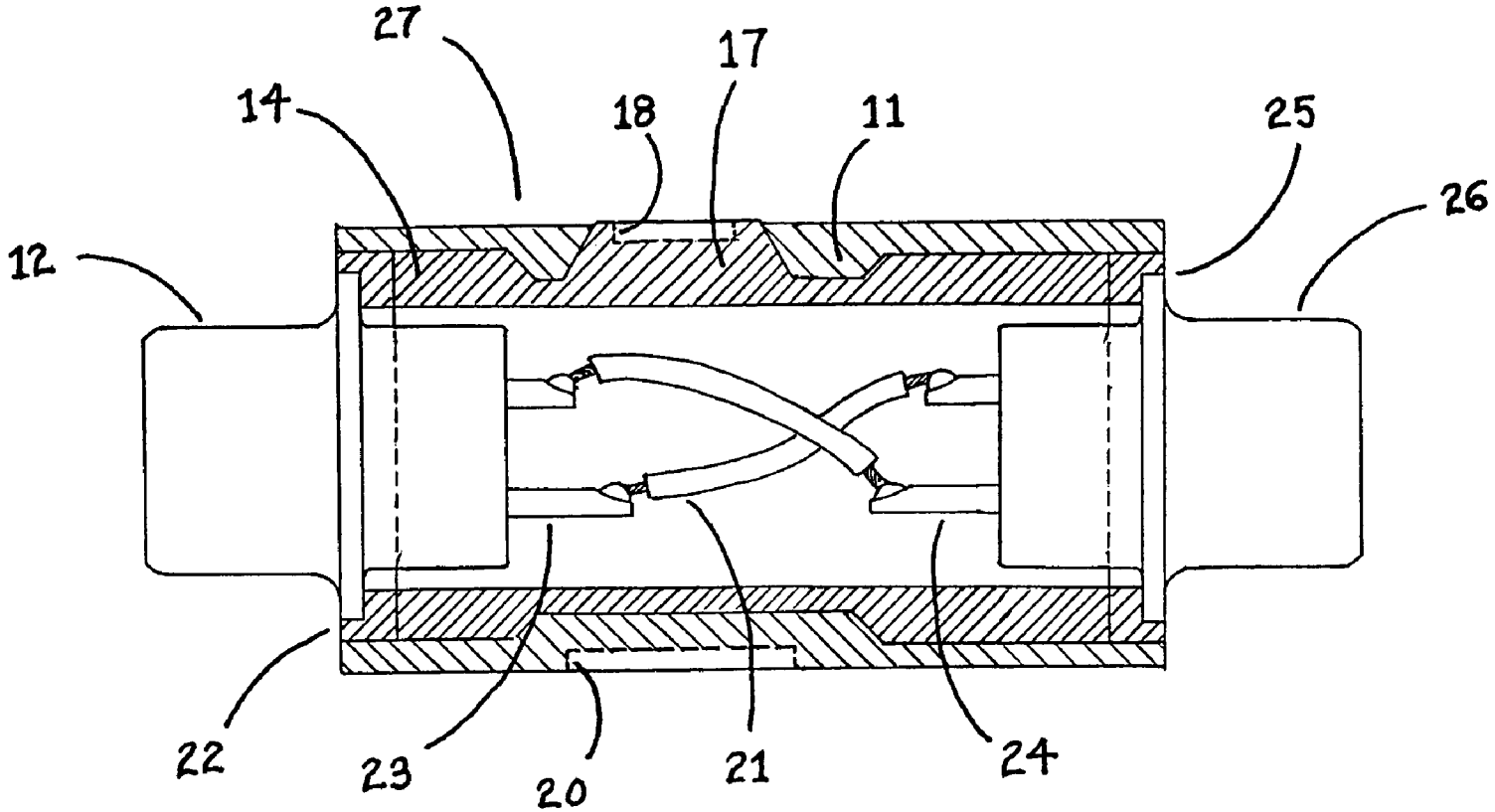
FIG. 4 is a cross-section view of an adapter according to the present invention.

The embodiments of the invention, described in detail below, use the same numbers shown in the FIG. 1 drawing of the prior art connector to designate similar elements or structures. Moreover, similar elements or structures shared with adapters, as shown in FIG. 4, are also designated with the same numbers used for the connectors shown in FIGS. 2 and 3.

Figure 2:
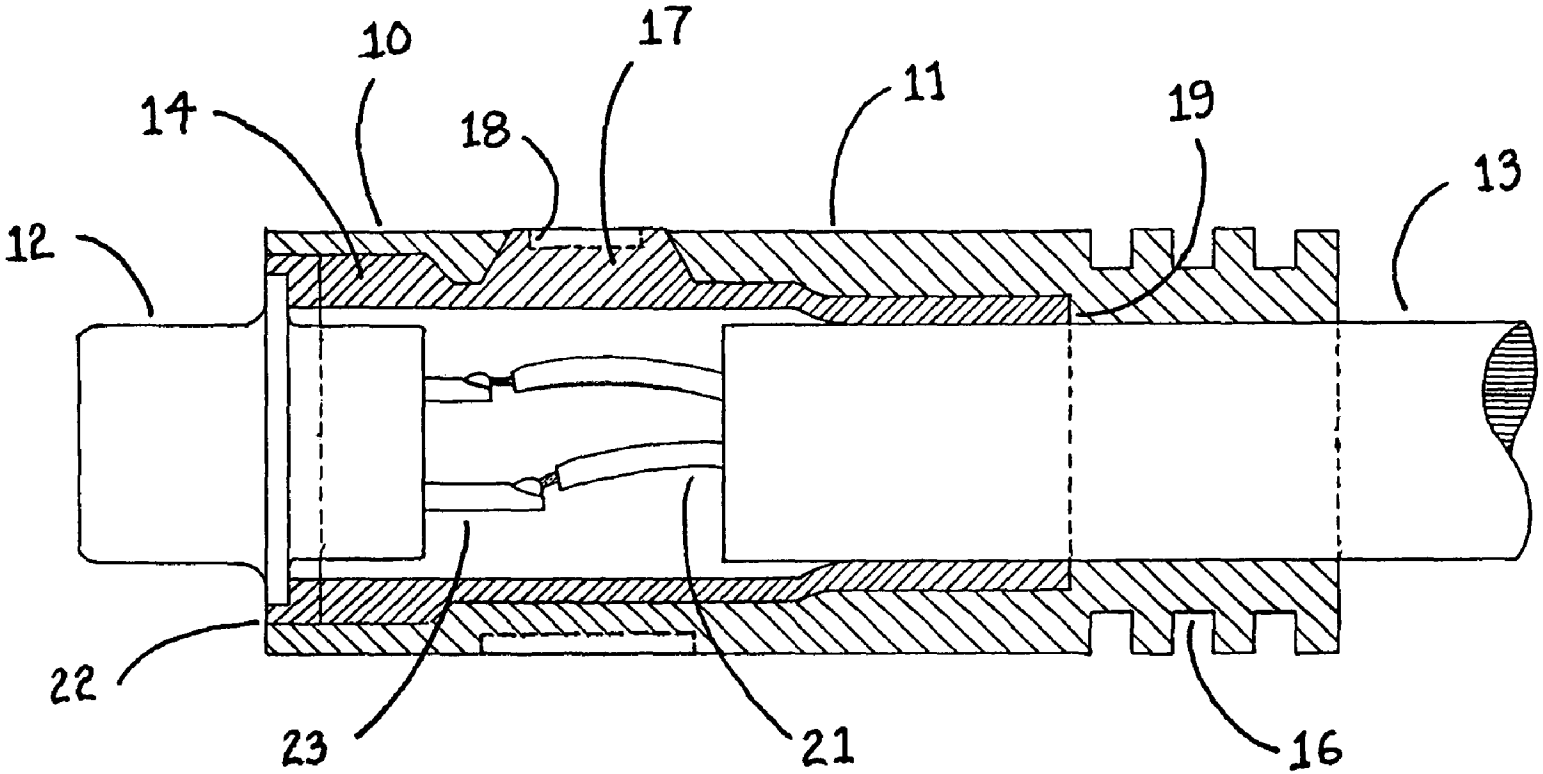
FIG. 2 is a cross-section view of a cable connector according to the present invention.

FIG. 2 shows one embodiment of the present invention applied to a computer cable connector assembly. A conventional connector plug 12, with pins or pin receptacles (not shown), is designed to be plugged into a conforming port in a component (not shown). The connector plug 12 is attached to the housing 14. The housing 14 is most commonly a metal structure intended to provide electromagnetic shielding to the electrical conductors 21 within. Conventional housings are sometimes formed from more than one piece, such as upper and lower halves (not shown), or as one piece. The embodiment shown in FIG. 2 shows a single-piece, molded metal housing 14. A cable 13, having several electrical conductors or wires 21, enters the housing 14 through a back end 19. The drawings show only two conductors 21, but this is merely illustrative; usually, more conductors 21 are involved. The conductors 21 are connected to the inward projections 23 of the pins or receptacles (not shown) by soldering or crimping.

A raised portion 17 of the housing 14 extends above the outer surface of the housing 14. In the embodiment shown in FIG. 2, the raised portion 17 is formed as part of the molded metal housing 14. It is also contemplated that the raised portion 17 could be applied to the housing 14 in other ways. For example, the raised portion 17 could be glued or soldered to the housing 14, or the raised portion 17 of the housing 14 could be formed as part of a stamping process. In any event, persons skilled in the art will recognize that a raised portion 17 may be incorporated into or formed onto a housing 14.

Once the connector 12, housing 14, and cable 13 are assembled, plastic is usually injection molded over the assembly to form an outer plastic covering 11. According to the present invention, the raised portion 17 will not be covered by the injection molded plastic covering 11, but will be exposed. The raised portion 17 may be higher than the outer covering 11, or it may even be a little lower, but the idea is that it is exposed after the outer covering 11 is placed over the housing.

The raised surface 17 provides a place where logos or information may be placed. For example, FIG. 3 shows a completed cable connector with a logo 18 molded into the raised portion 17. Thus, after manufacturing and assembly, the cable connector will have a clearly visible area on the raised portion 17, not covered by the injection molded plastic covering 11, where a logo or information may be seen. Also, the raised portion 17 can also provide a surface, above the injection molded plastic covering 11, for a gripping surface (not shown).

FIG. 4 shows one embodiment of the present invention applied to a computer adapter assembly. Adapters are used for many purposes in the computer industry, such as adapting one plug configuration to a different plug configuration, or as "gender changers", or to provide adapting circuitry or electronics. An adapter is shown generally at 27. A first conventional connector plug 12, with pins or pin receptacles (not shown), is designed to be plugged into a conforming port in a component or cable (not shown). The first connector plug 12 is attached to the housing 14. The housing 14 is most commonly a metal structure intended to provide electromagnetic shielding to the electrical conductors 21 within. Conventional housings are sometimes formed from more than one piece, such as upper and lower halves (not shown), or as one piece. A second conventional connector plug 26 is attached to the other end 25 of the housing 14. Conductors or wires 23 are connected, usually by crimping or soldering, to extensions 23 from the pins or receptacles (not shown) of the first connector 12. The conductors 23 are then connected, directly or indirectly, to extensions 24 from the pins or receptacles (not shown) of the second connector 26. In the embodiment shown, the conductors 23 are wires connected directly from the first connector 12 to the second connector 26. However, conventional adapters use many different methods of for making these connections. For example, one common method is to use a printed circuit board (not shown) between the connectors. Additionally, adapters sometimes have more than two connectors. The present invention does not concern the method for providing an electrical connection between plug connectors of adapters or cable connectors, and the structures shown are merely illustrative.

A raised portion 17 of the housing 14 extends above the outer surface of the housing 14. In the embodiment shown in FIG. 4, the raised portion 17 is formed as part of the molded metal housing 14. It is also contemplated that the raised portion 17 could be applied to the housing 14 in other ways, as mentioned above. Once the connectors 12 and 26, housing 14, and conductors 23 are assembled, plastic is usually injection molded over the assembly to form an outer plastic covering 11. According to the present invention, the raised portion 17 will not be covered by the injection molded plastic covering 11, but will be exposed. The raised portion 17 may be higher or a little lower than the outer covering 11, as described above. As with the cable connector 10 described above, the raised portion 17 of the adapter 27, shown in FIG. 4, may be used as a surface for molded logos or designs 18, labels (not shown), or a gripping surface (not shown).

The drawings and description set forth here represent only some embodiments of the invention. After considering these, skilled persons will understand that there are many ways to make an electrical connector or adapter structure according to the principles disclosed. The inventor contemplates that the use of alternative structures, which result in an electrical connector or adapter structure using the principles disclosed and the invention claimed, will be within the scope of the claims.

What I claim is:

1. An electrical connector structure comprising:

a housing formed of a metal material and having an outer surface and at least one end adapted to hold an electrical connector plug, wherein the housing has a raised portion, unitarily formed of said metal material along wit said housing, above the outer surface of the housing, a plastic covering formed over the outer surface of the housing, wherein the covering is further formed around the raised portion so that an exposed part of the raised portion is not covered by the covering, wherein the exposed part of the raised portion further comprises a background surface and a design surface also formed of said material along with the raised portion and the housing, and wherein the design surface is formed as part of the background surface and is not level with the background surface.

2. The electrical connector structure of claim 1 wherein the design surface is a sub-surface design below the background surface formed along with the housing and raised portion of said material.

3. The electrical connector structure of claim 2 wherein the sub-surface design is formed in the background surface of the raised portion of the housing during molding of the housing.

4. The electrical connector structure of claim 2 wherein the sub-surface design is formed in the background surface of the raised portion of the housing by machining.

5. The electrical connector structure of claim 2 wherein the sub-surface design is formed in the background surface of the raised portion of the housing by stamping

6. The electrical connector structure of claim 1 wherein the design surface is an above-surface design above the background surface formed along with the housing and raised portion of said material.

7. The electrical connector structure of claim 6 wherein the above-surface design is formed in the background surface of the raised portion of the housing during molding of the housing.

8. The electrical connector structure of claim 6 wherein the above-surface design is formed in the background surface of the raised portion of the housing by machining.

9. The electrical connector structure of claim 6 wherein the above-surface design is formed in the background surface of the raised portion of the housing by stamping.

10. The electrical connector structure of claim 1 wherein the design surface is a gripping surface design formed along with the housing and raised portion of said material, wherein the gripping surface design comprises ridges.

11. An electrical adapter structure comprising:

a housing formed of a metal material and having an outer surface and at least one end adapted to hold an electrical connector plug, wherein the housing has a raised portion, unitarily formed of said metal material along with the housing, above the outer surface of the housing, a plastic covering formed over the outer surface of the housing, wherein the covering is further formed around the raised portion so that an exposed part of the raised portion is not covered by the covering, wherein the exposed part of the raised portion farther comprises a background surface and a design surface also formed of said material along with the raised portion and the housing, and wherein the design surface is formed as part of the background surface and is not level wit the background surface.

12. The electrical adapter structure of claim 11 wherein the design surface is a sub-surface design below the background surface formed along with the housing and raised portion of said material.

13. The electrical adapter structure of claim 11 wherein the design surface is an above-surface design above the surface of the background surface formed along with the housing and raised portion of said material.

14. The electrical adapter structure of claim 11 wherein the design surface gripping surface design formed along with the housing and raised portion of said material, wherein the gripping surface design comprises ridges.

15. A method of manufacturing an electrical connector structure comprising the steps of:

in a first manufacturing step, forming a housing of a metal material, wherein the housing comprises an outer surface and at least one end adapted to hold an electrical connector plug, wherein the outer surface farther comprises at least one face, and wherein a raised portion is formed of said material along with the housing, wherein the raised portion is raised above the face of the outer surface of the housing, and wherein the raised portion further comprises side wails extending up from the face and a background surface substantially parallel to the face and a design surface formed in the background surface, wherein the design surface is formed of said material along with the raised portion and the housing, and wherein the design surface is formed as part of the background surface and is not level with the background surface, and in a non-metal manufacturing step, forming a cover of a second material over the outer surface of the housing, wherein the cover is formed around the side walls of the raised portion.

* * * * *